United States Patent [19]

Shiozaki et al.

[11] Patent Number: 4,934,847

[45] Date of Patent: Jun. 19, 1990

[54] THERMAL TRANSFER PRINTER WITH RIBBON TENSIONING MECHANISM

[75] Inventors: Tsugio Shiozaki, Susono; Osamu Koizumi, Shizuoka; Ikuzo Sugiura, Sagamihara, all of Japan

[73] Assignee: Tokyo Electric Co., Ltd., Tokyo, Japan

[21] Appl. No.: 256,692

[22] Filed: Oct. 11, 1988

[30] Foreign Application Priority Data

Oct. 14, 1987 [JP] Japan ..... 62-157118[U]

[51] Int. Cl.[5] ..... B41J 3/02; B41J 32/00

[52] U.S. Cl. ..... 400/120; 400/234

[58] Field of Search ..... 400/120, 234

[56] References Cited

U.S. PATENT DOCUMENTS

| | | | |
|---|---|---|---|
| 4,611,937 | 9/1986 | Sato et al. | 400/234 |
| 4,744,680 | 5/1988 | Hirosaki et al. . | |
| 4,838,718 | 6/1989 | Okumura et al. | 400/234 |

FOREIGN PATENT DOCUMENTS

| | | | |
|---|---|---|---|
| 69081 | 4/1982 | Japan | 400/234 |
| 64878 | 4/1985 | Japan | 400/234 |
| 228178 | 11/1985 | Japan | 400/120 |
| 61-266271 | 11/1986 | Japan . | |
| 119089 | 5/1987 | Japan | 400/120 |
| 221584 | 9/1987 | Japan | 400/120 |
| 261474 | 11/1987 | Japan | 400/120 |

*Primary Examiner*—Eugene H. Eickholt

*Attorney, Agent, or Firm*—Frishauf, Holtz, Goodman & Woodward

[57] ABSTRACT

A thermal transfer printer comprises a pair of fixed frames for rotatably supporting a platen, a pair of movable frames supporting a thermal head, the movable frames being connected to the fixed frames so as to be rockable around a shaft, between a position where the thermal head is pressed against the platen and a position where the thermal head is moved away from the platen. The ink ribbon is supported by a supply roll and a take-up roll and may be alternately transported in one direction such that the ink ribbon is directed toward the region between the thermal head and the platen or in the direction opposite thereto. The movable frame is provided with operating member adapted to drive the supply roll to move the ink ribbon in the opposite direction, thereby applying a tension of the opposite direction to the ink ribbon, when the movable frame is rocked so that the thermal head is pressed against the platen.

20 Claims, 8 Drawing Sheets

THERMAL TRANSFER PRINTER WITH RIBBON TENSIONING MECHANISM

BACKGROUND OF THE INVENTION

1. Field of the Invention

The present invention relates to a thermal transfer printer in which heat-fusible or -sublimable ink applied to a ribbon is transferred to a paper sheet by means of Joule heat produced by heating a thermal printing head, and more particularly, to a thermal transfer printer adapted for printing characters and bar codes on paper sheets, such as labels.

2. Description of the Related Art

As an example of the conventional thermal transfer printer of this type, there is a label printer which is disclosed in Japanese Patent Disclosure No. 61-266271 (corresponding to U.S. Pat. No. 4,744,680, issured on May 17, 1988) assigned to the same assignee as the present application.

In this label printer, characters and bar codes are printed on a label sheet by means of a line thermal printing head with a large printing width. In printing, the printing head is pressed against an platen with a ink ribbon and the label sheet between the head and the platen. This prior printer invention is characterized in that a printer unit, in which a line thermal head and ink ribbon supply and take-up spindles are mounted on a pair of frames, is rockably or movably attached to a fixed mechanism section of a casing of the printer.

According to the prior art printer described above, when the thermal printing head is pressed against the platen, the ink ribbon between ink ribbon supply and take-up rolls may slacken, thus failing to produce a clear print and, therefore, entailing defective printing.

SUMMARY OF THE INVENTION

The object of the present invention is to provide a thermal transfer printer capable of preventing an ink ribbon between ink ribbon supply and take-up rolls from slackening when a thermal printing head is pressed against a platen.

According to the present invention, there is provided a thermal transfer printer which comprises: a platen; platen supporting means for supporting the platen; a thermal head; ink ribbon supply means for feeding an ink ribbon between the platen and the thermal head; thermal head supporting means movable relatively to the platen supporting means and supporting the thermal head, the thermal head supporting means being adapted to be moved so as to press the thermal head against the platen across the ink ribbon and a paper sheet; and ink ribbon looseness removing means for applying a tension of at least one direction to the ink ribbon, situated between the thermal head and the platen, by moving when the thermal head supporting means is moved so that the thermal head is pressed against the platen, the direction of the tension being an ink ribbon feeding direction or the direction opposite thereto.

Thus, in the thermal transfer printer according to the present invention, when the thermal printing head is moved so as to be pressed against the platen, a tension is applied to the ink ribbon, thereby preventing the ribbon from slackening.

DETAILED DESCRIPTION OF THE PREFERRED EMBODIMENTS

Figure 1A:
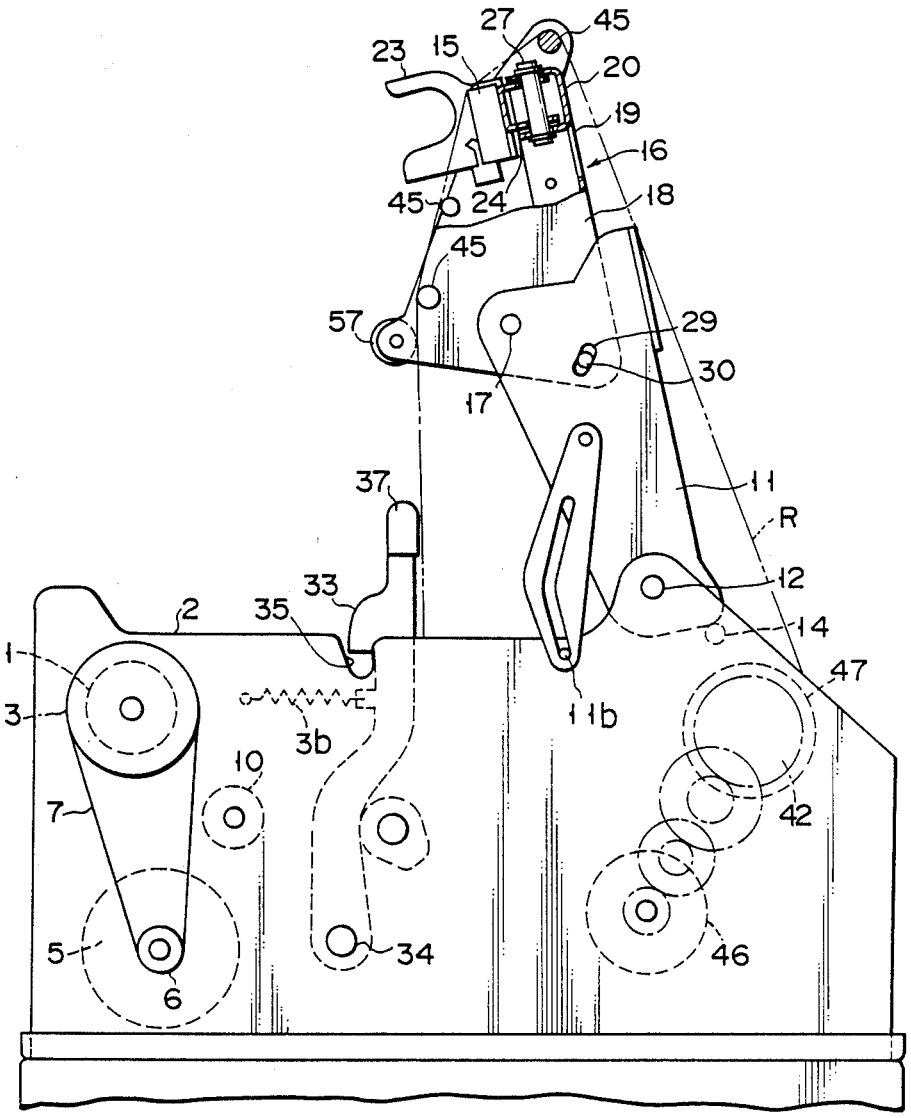
FIGS. 1A and 1B are right- and left-hand side views, respectively, of a thermal transfer printer according to an embodiment of the present invention.
Figure 1B:
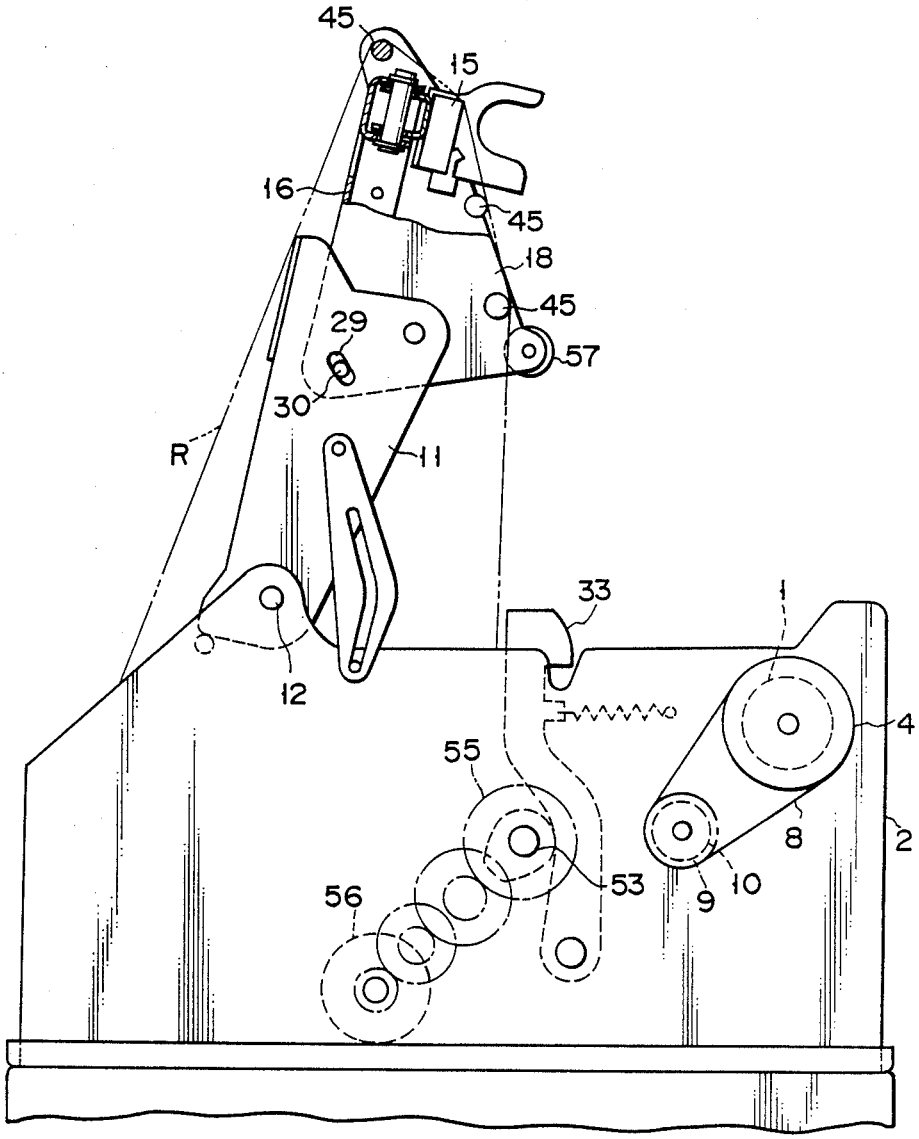

Referring now to the drawings of FIGS. 1 to 8, a thermal transfer printer according to an embodiment of the present invention will be described in detail.

In these drawings, numeral 1 designates a roller-shaped platen which is rotatably supported, at both ends thereof, on a pair of fixed frames (fixed supporting means for a platen) which are opposed to each other at a predetermined distance. Timing gears 3 and 4 are fixed individually to the respective projecting ends of slender platen shafts 21 at either end of platen 1. Timing belt 7 is passed around timing gear 3 (FIG. 1A) and motor gear 6 so that the driving force of platen drive motor 5 can be transmitted to gear 3 by means of motor gear 6 and belt 7. Motor 5 is mounted on the inside of one of fixed frames 2 with its rotating shaft protecting from the frame, for rotation in both forward and reverse directions. The other timing gear 4 is connected to timing belt 8 (FIG. 1B) so that the rotation of motor 5 can be transmitted to timing gear 9 through belt 8. Gear 9 is mounted on one end of sheet feeding roller 10 which is rotatably supported, at both ends thereof, on fixed frames 2. Thus, roller 10 can be rotated in the same direction as platen 1.

Figure 2:
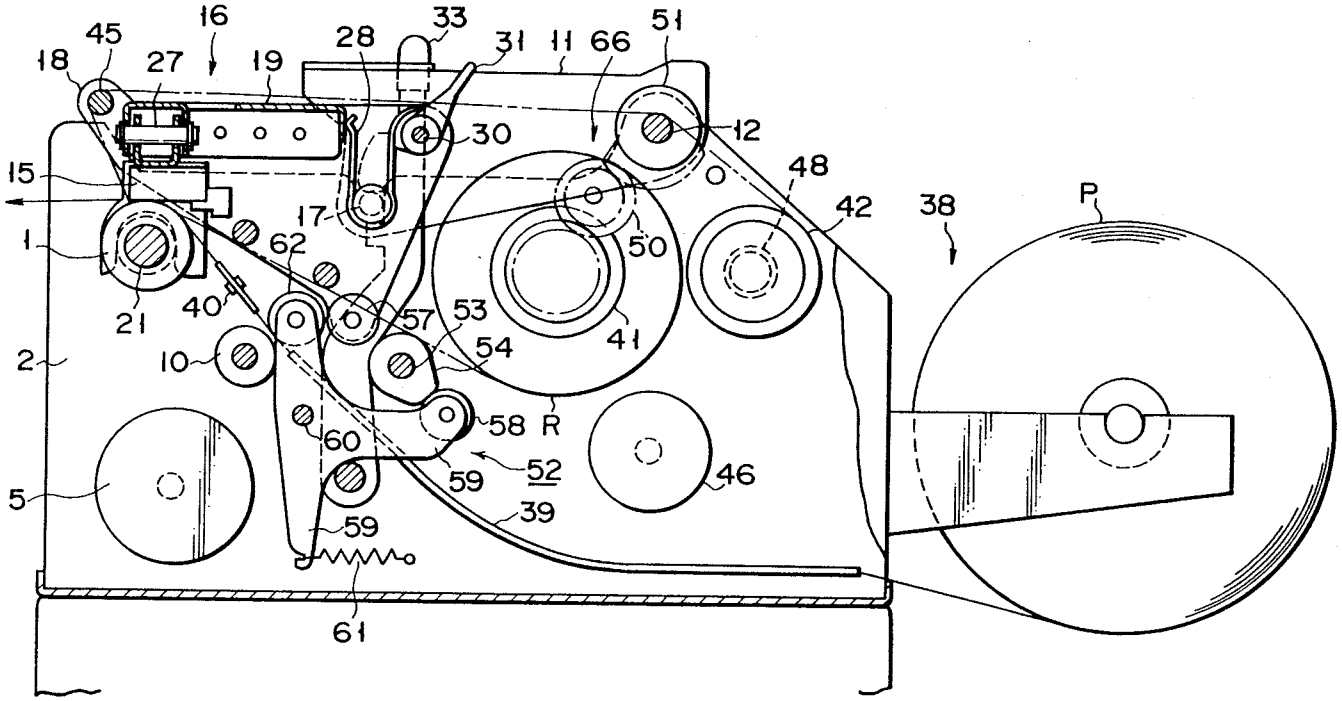
FIG. 2 is a vertical sectional view of the printer.

A pair of movable frames (movable supporting means for a thermal head) 11 are rockably mounted on the top portions of their corresponding fixed frames 2 by means of frame shaft 12 so that the top of platen 1 can be exposed. Shaft 12 is rockably supported, at both ends thereof, on fixed frames 2, and frames 11 are mounted on the opposite end portions of shaft 12 for associated rocking motion. Thus, movable frames 11 are rockable together with frame shaft 12 around the axis thereof, between an open position, where the top portion of the printer between fixed frames 2 is open, as shown in FIG. 1A, and a closed position where the top portion is closed, as shown in FIG. 2. Auxiliary frame 11*a* is pivotally mounted on each movable frame 11, and tension spring 13 is stretched between frame 11*a* and its corresponding fixed frame 2. A slit is bored through each auxiliary frame 11*a*, and guide pin 11*b* protrudes from each fixed frame 2. As pins 11*b* are loosely fitted in the respective slits of their corresponding auxiliary frames 11*a*, movable frames 11 are urged toward the open position by the action of springs 13. When movable frames 11 engage their corresponding stopper shafts 14 on the inside of fixed frames 2, they are retained in the open position.

Head unit 16 is rockably supported on the front end portions of movable frames 11 by means of support shaft 17. Elongated line thermal head 15, which is adapted to be pressed against platen 1, is swingably held on unit 16 with the aid of the means mentioned later. The head unit includes a pair of head arms 18 facing each other and head base 19 fixed to the inside of arms 18. Arms 18 are rockably supported on movable frames 11 by means of support shaft 17.

Head holding portion 20, having a U-shaped cross section and open at the bottom, is formed at the central portion of the front end of head base 19. Holding portion 20 extends along the longitudinal axis of head base 19 (parallel to support shaft 17).

Line thermal head 15 has an elongated configuration extending along the longitudinal axis, and head bracket 23 is fixed to the back of the head. Bracket 23 has engaging recesses 22 individually at its opposite ends, which are adapted to releasably engage platen shaft 21 of platen 1. The engaging portions protrude forward from thermal head 15. U-shaped head coupling portion 24, which is open at the top, is provided on the central portion of bracket 23. Coupling shaft 27, which extends at right angles to the longitudinal axis, is passed through holes 25 and 26 in the center of coupling portion 24 and head holding portion 20, respectively. Thus, line thermal head 15 is mounted on holding portion 20 so as to be swingable around shaft 27. In other words, head 15 is mounted on head base 19 so that it is swingable around an axis parallel to its front face and perpendicular to the direction of its length. The respective central portions of a pair of leaf springs 28 having a U-shape are coiled around support shaft 17 (FIGS. 2 and 5A to 5C). One end of each spring 28 is held against the rear end of head base 19, thereby urging head unit 16 to rock around shaft 17 toward the platen. Each movable frame 11 has arcuate slot 29 whose center of curvature lies on the axis of support shaft 17. Cam shaft 30 is rockably attached to head unit 16. As both end portions of shaft 30 are fitted in their corresponding slots 29, the rocking motion of head unit 16, i.e., line thermal head 15, relative to movable frames 11, is restricted within a predetermined range.

Figure 4A:
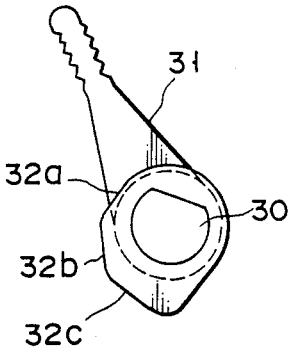
FIGS. 4A and 4B are a side view and a perspective view, respectively, of a head adjusting cam of the printer.
Figure 4B:
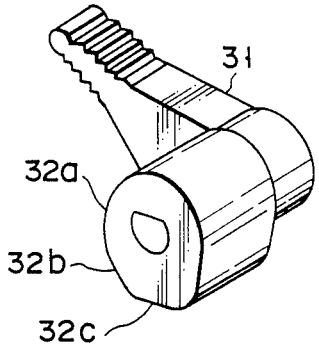
Figure 5A:
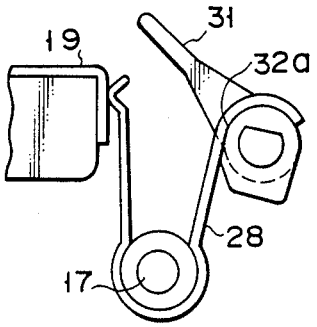
FIGS. 5A, 5B and 5C are side views individually showing different operating states of the adjusting cam.
Figure 5B:
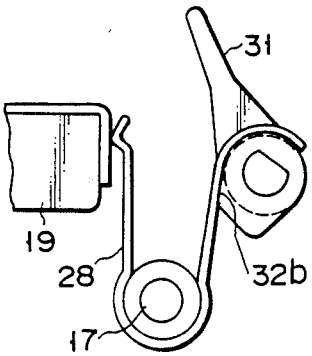
Figure 5C:
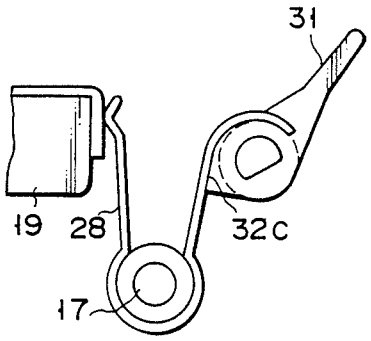
Figure 6:
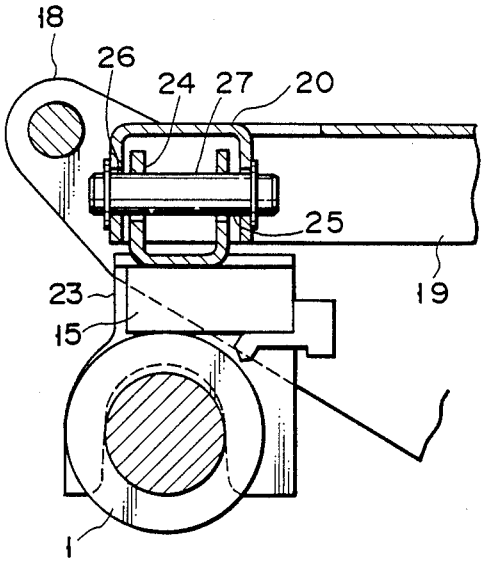
FIG. 6 is a sectional view showing a support structure for a thermal printing head of the printer.

A pair of head adjusting cams 31 are mounted on cam shaft 30. They serve to adjust the urging force of leaf springs 28 by stages. As shown in FIGS. 4A and 4B, a plurality of flat cam faces 32*a*, 32*b* and 32*c* are formed along the outer periphery of cam 31 so that they are situated at different distances from cam shaft 30. A flat face of each leaf spring 28 at the other end portion thereof is urged to be in plane contact with any of flat cam faces 32*a* to 32*c*. In this embodiment, each head adjusting cam has three cam faces. First cam face 32*a* is nearer to shaft 30 than the other two are, and third cam face 32*c* is the remotest. Thus, if spring 28 engages first cam face 32*a*, as shown in FIG. 5A, it applies the smallest urging force to line thermal head 15 to be pressed against the surface of platen. If spring 28 engages second and third cam face 32*b*, 32*c*, as shown in FIGS. 5B, 5C, it applies a greater and the greatest urging forces to head 15, respectively. Since these cam faces are flat surfaces, they serve to lock cam 31 in position as they are engaged by spring 28, unless a lever of the cam is rocked. The selection of the cam face to be engaged depends on the thickness and quality of the paper sheet used. If the sheet is relatively thick or firm, cam 31 is set in the position shown in FIG. 5C to produce the greatest urging force. If the sheet is thin or weak, on the other hand, the cam is set in the position shown in FIG. 5A to reduce the urging force. The urging force of spring 28 to press thermal head 15 toward platen 1 is changed when the position of head bracket 23 relative to platen shaft 21 is slightly shifted.

Paired head adjusting cams 31, which are fixed to cam shaft 30, are adapted to rock together therewith. Therefore, they need not always be two in number, and it is necessary only that at least one adjusting cam be provided for the purpose. Cams 31 are located exposed beside movable frames 11 in order that they can be manually operated from the outside. The respective lower ends of a pair of lock levers 33 are pivotally mounted on the inner surfaces of their corresponding fixed frames 2 by means of shaft 34. Both end portions of shaft 34 are rockably supported on their corresponding fixed frames 2. Thus, lock levers 33 are mounted on frames 2 so as to be rockable around the axis (indicated by line B—B in FIG. 3) of shaft 34. When movable frames 11 are brought to the closed position, levers 33 engage the top of support shaft 17 so that shaft 17 is fitted and retained in recesses 35 formed in the respective top edges of fixed frames 2, thereby preventing movable frames 11 from rocking. Each lever 33 is urged in the counterclockwise direction of FIG. 1A by means of tension spring 3*b*. Knob 37 is attached to one of lock levers 33. If knob 37 is operated to rock levers 33 in the clockwise direction of FIG. 1A, against the urging force of springs 3*b*, movable frames 11 are released from the locked state. In rocking frames 11 to the closed position, support shaft 17 is held against the lateral faces of lock levers 33, and levers 33 are rocked against the urging force of springs 3*b*. When movable frames 11 are rocked in this manner, they are locked automatically.

Sheet holding member 38 for holding wide label sheet P protrudes from the rear end portions of fixed frames 2. It comprises a pair of support arms spaced in the longitudinal direction of the printer. A bearing or recess is formed on the top surface of each support arm. Rolled label sheet P is wound around a support shaft, both end portions of which project individually from the opposite sides of sheet P. As the projecting end portions of the shaft are rotatably supported by the bearings of the support shafts, sheet P is held by holding portion 38 so as to be rotatable around the axis of the support shaft. The leading end of sheet P is drawn out from its outermost periphery. Thus, sheet P is guided to a printing section through sheet guide passage 39, which comprises of a pair of curved plates vertically spaced at a very short distance from each other and arranged below movable frames 11. Paper sensor 40 is attached to that portion of passage 39 situated between platen 1 and sheet feeding roller 10. Sensor 40 serves to optically detect the presence of label sheet P, that is, the leading end of the sheet.

Ink ribbon supply roll 41 and ink ribbon take-up roll 42 are rotatably mounted on the inside of fixed frames 2. Supply roll 41 serves to feed wide ink ribbon R to the printing section, while take-up roll 42 is used to wind the used portion of the ink ribbon. Rolls 41 and 42 are removably held by their corresponding pairs of roll holders 43 and 44, which are mounted individually on the inside of frames 2. Ink ribbon R on supply roll 41 is wound around take-up roll 42 after being passed around a plurality of ribbon guide shafts 45 (three in this embodiment), which are fixed to head arms 18 and extend parallel to the longitudinal axis of the printer. One of paired roll holders 43 is pressed against one end face of roll 41 by means of a coil spring disposed between itself and its corresponding fixed frame 2. Likewise, one of roll holders 44 is pressed against one end face of roll 42 by means of another coil spring disposed in the same manner. Thus, rolls 41 and 42 can be easily mounted on or removed from their corresponding holders 43 and 44. The other of holders 44 for take-up roll 42 is coaxially connected to take-up gear 47 by means of one-way clutch 48. As shown in FIG. 1A, take-up gear 47 is operatively connected, by means of a gear train, to take-up motor 46 which is fixed to the inside of one of fixed frames 2. Thus, as the driving force of motor 46 is transmitted to ink ribbon take-up roll 42 via take-gear 47 and one-way clutch 48, roll 42 is rotated in a take-up direction or the clockwise direction of FIG. 2. Feed gear 49, which contains one-way clutch **49*a* therein, is coaxially attached to the other of roll holders 43 which hold ink ribbon supply roll 41. Gear 49 is in mesh with a large-diameter portion of intermediate gear 50, a double-gear. A small-diameter portion of gear 50 is in mesh with ribbon rewinding gear 51 which is coaxially fixed to frame shaft 12 between movable frames 11. Gear 51 is composed of a sector gear whose center is on the axis of shaft 12. Thus, when movable frames 11 are rocked to the closed position, rewinding gear 51 also rocks, thereby causing intermediate gear 50 to rotate through an angle corresponding to the rocking motion of frames 11. The rotation of gear 50 is transmitted through feed gear 49 to the other roller holder 43. Thereupon, supply roll 41 is rotated through a predetermined angle in the clockwise direction of FIG. 2**, i.e., in the direction opposite to a ribbon feeding direction.

Figure 3:
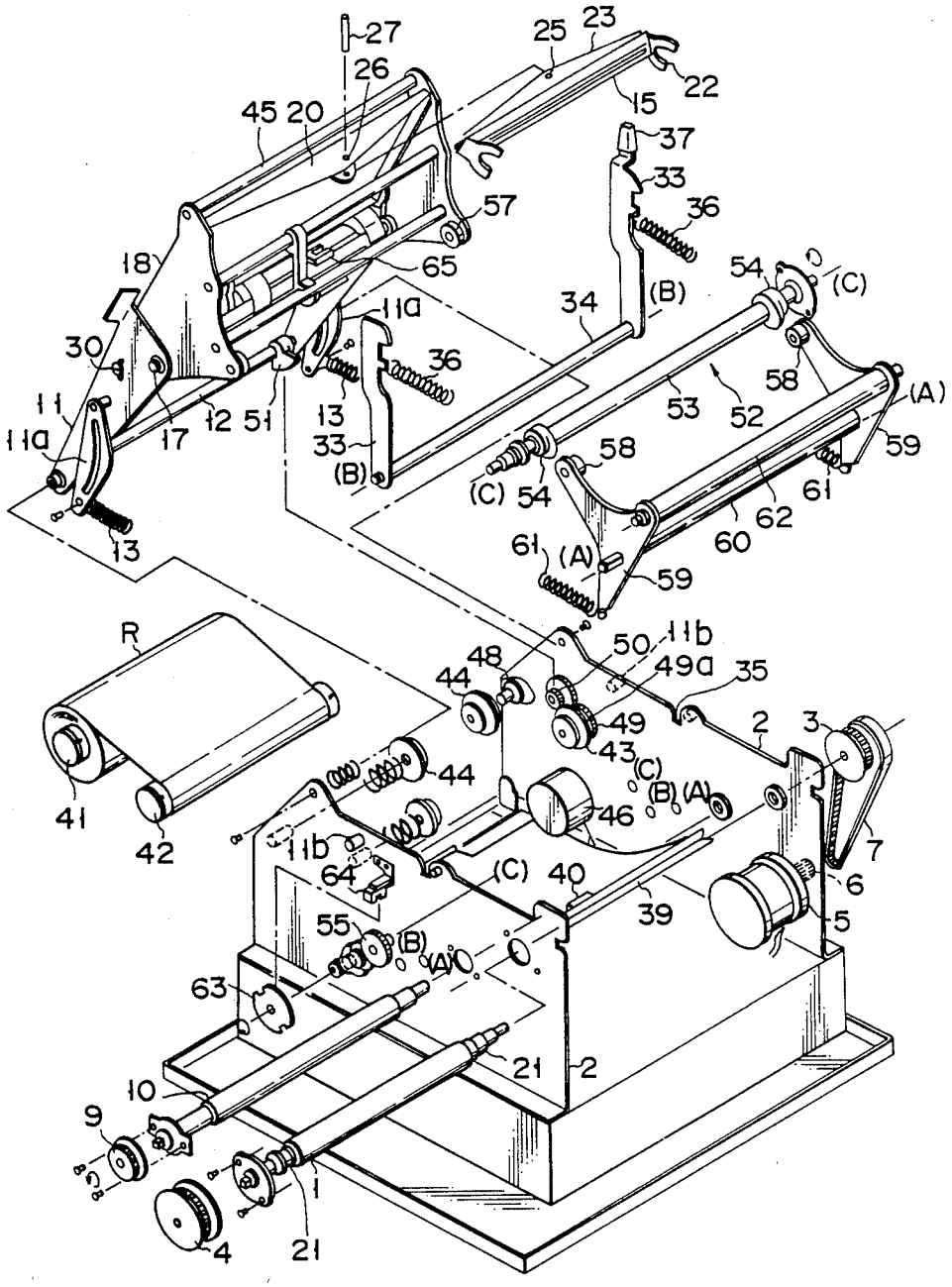
FIG. 3 is an exploded perspective view of the printer.
Figure 7:
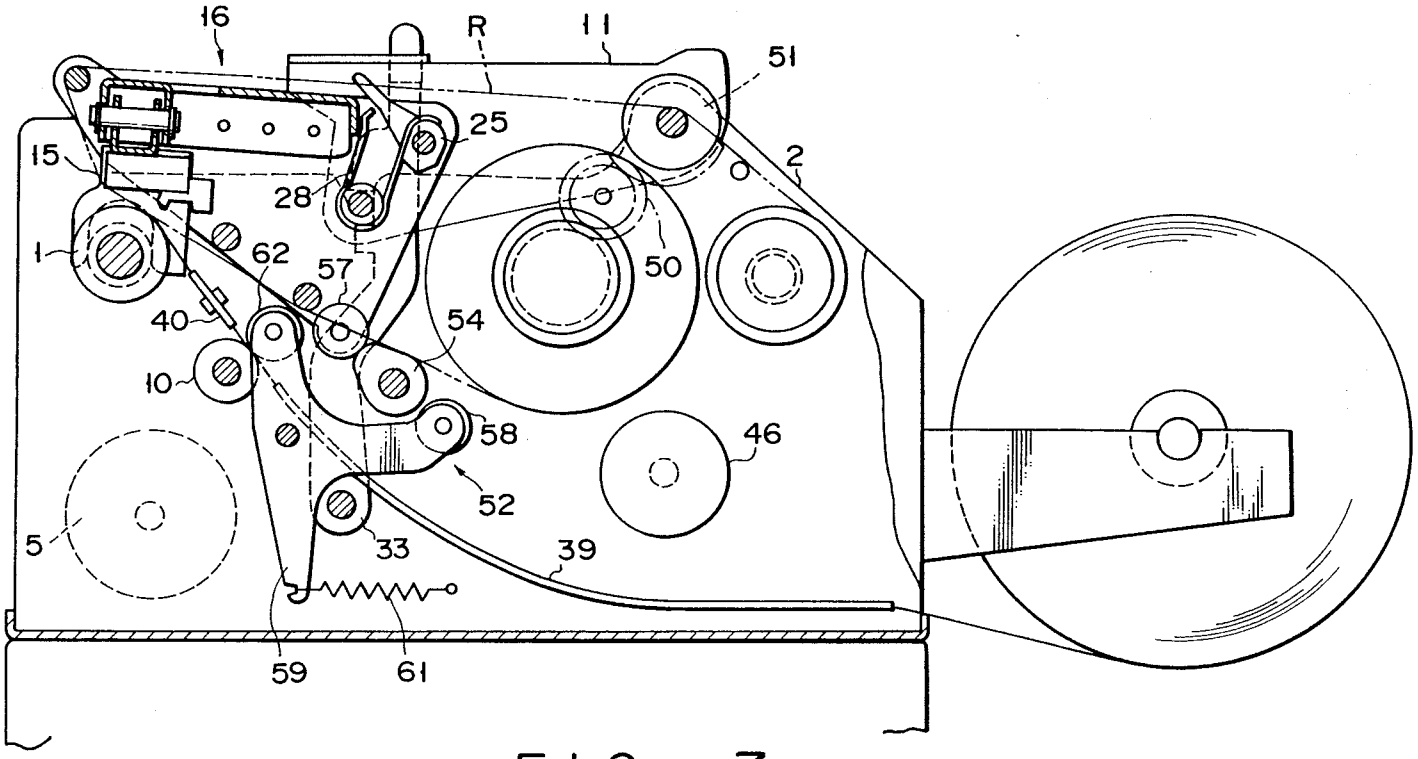
FIG. 7 is a sectional view, similar to FIG. 2, illustrating the operation of a head-up mechanism of the printer.

Head-up mechanism 52 is located beside sheet feeding roller 10. It serves to temporarily force up line thermal head 15, in pressure contact with platen 1, when movable frames 11 are in the closed position. As shown in FIG. 3, mechanism 52 includes cam shaft 53 and a pair of cams 54 fixed individually to the opposite end portions of shaft 53. Shaft 53, which extends in the longitudinal direction (line C—C) of the printer, is rotatably supported, at both ends thereof, to fixed frames 2. Gear 55 (FIG. 1B) is coaxially mounted on one end of cam shaft 53. It is connected, by means of a gear train, to cam drive motor 56 which attached to the other fixed frame 2. Thus, cam 54 is rotated by means of motor 56. A pair of head-up rollers 57 are rotatably mounted on head arms 18, individually, so that they are situated in the paths of rotation of their corresponding cams 54 when movable frames 11 are in the closed position. A pair of sheet rewinding arms 59 are arranged inside those portions of fixed frames 2 near sheet feeding roller 10. Each end portion of shaft 60, which extends parallel to roller 10, is fixed to the central portion of each corresponding arm 59. Both ends of shaft 60 are movably supported on fixed frames 2, individually. As shaft 60 rocks, arms 59 can rock together therewith around the longitudinal axis (line A—A) of shaft 60. Pinch roller 62, which extends parallel to roller 10, is rotatably supported, at both ends thereof, on sheet rewinding arms 59. Tension spring 61 is disposed between each arm 59 and its corresponding fixed frame 2. As shown in FIG. 7, spring 61 urges arm 59 to rock in the counterclockwise direction, thereby pressing pinch roller 62 against sheet feeding roller 10. Release rollers 58, which can engage cams 54, are rotatably mounted on sheet rewinding arms 59, individually. When cams 54 engage their corresponding rollers 58, arms 59 are rocked against the urging force of springs 61, so that pinch roller 62 is disengaged from roller 10. In FIG. 3, numeral 63 designates a cam detecting plate attached to one end of cam shaft 53. Numeral 64 designates a cam sensor for optically detecting the rotational position of cams 54 through detecting plate 63, while numeral 65 denotes a ribbon sensor for optically detecting the presence of ink ribbon R.

In printing on a wide label sheet P, in the printer with the arrangement described above, ink ribbon supply roll 41 and ink ribbon take-up roll 42 are first set inside fixed frames 2. The leading end of ink ribbon R, wound around supply roll 41, is passed around ribbon guide shafts 45 between head arms 18, and is then anchored to take-up roll 42. Meanwhile, the leading end portion of label sheet P, held by sheet holding portion 38, is drawn out and passed through sheet guide passage 39 to be set on platen 1. Then, in this state, movable frames 11 are brought down to the closed position, where they are fixed to fixed frames 2, and line thermal head 15 is pressed against platen 1. As movable frames 11 rock in this manner, ribbon rewinding gear 51 also rock, thereby causing ribbon supply roll 41 to rotate in the counterclockwise direction of FIG. 2, through the medium of intermediate gear 50 and feed gear 49. Thereupon, ink ribbon R, which is drawn out long to cover ribbon take-up roll 42 via supply roll 41 and thermal head 15, is rewound. Accordingly, a tension toward supply roll 41 is applied to ribbon R, so that the ribbon can be prevented from slackening or be smoothed out. Ribbon rewinding gear 51 rocks also when movable frames 11 are raised from fixed frames 2. In this case, however, ribbon supply roll 41 never rotates, since one-way clutch **49*a* is contained in feed gear 49**.

When line thermal head 15 is pressed against platen 1, moreover, cam drive motor 56 is caused to rotate for a predetermined amount by means of a detection switch (not shown). Thereupon, cams 54, having so far been in engagement with release rollers 58, are caused to engage head-up rollers 57. Thus, pinch roller 62 is pressed against sheet feeding roller 10, and thermal head 15 is forced up through the medium of head arms 18, as shown in FIG. 7.

When line thermal head 15 is lifted from platen 1, platen drive motor 5 rotates reversely. Thus, label sheet P, held between pinch roller 62 and sheet feeding roller 10, is retreated from platen 1 as roller 10 rotates. When paper sensor 40 detects passage of the leading end of sheet P, the rotation of motor 5 is stopped in response to an output signal from the sensor. Thereupon, the leading end of the sheet is set in a predetermined position behind sensor 40, whereupon its alignment is completed. In this state, platen drive motor 5 rotates forward, and cam drive motor 56 rotates again for a predetermined amount in response to the output signal from sensor 40, after the passage of a predetermined time (or when sheet P is brought onto platen 1). As a result, cams 54, having so far been in engagement with head-up rollers 57, are caused to engage release rollers 58. Thus, thermal head 15 is pressed again against platen 1 with the leading end portion of sheet P between the two, and pinch roller 62 is separated from sheet feeding roller 10, as shown in FIG. 2. Thereafter, thermal head 15 is heated to accomplish a specific cycle of printing operation, and platen 1 is rotated to feed label sheet P forward.

Figure 8:
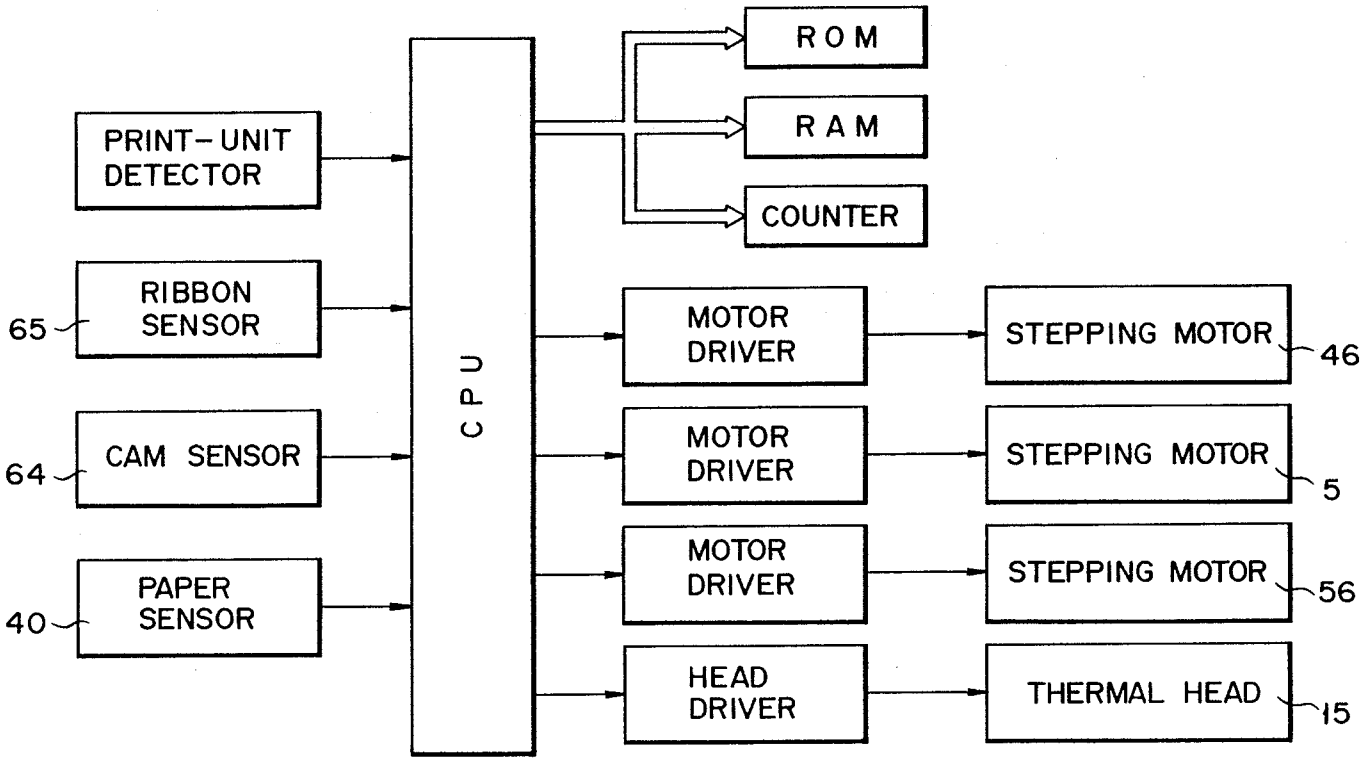
FIG. 8 is a block diagram of an electrical control system of the printer.

FIG. 8 shows an electrical control system of the thermal transfer printer with the aforementioned construction. As seen from FIG. 8, a CPU is used as a principal control means for the printing operation. In this system, a ROM and a RAM are designed for label layout, just as in the case of the prior art printers.

What is claimed is:

1. A thermal transfer printer comprising:

a platen (1);

platen supporting means (2) for supporting the platen;

a thermal head (15);

ink ribbon supply means (41, 42, 46, 47) for feeding an ink ribbon (R) between the platen and the thermal head;

thermal head supporting means (11, 16) movable relatively to the platen supporting means and supporting the thermal head, said thermal head supporting means being movable for pressing the thermal head against the platen across the ink ribbon and a paper sheet; and ink ribbon looseness removing means (49, 50, 51) which is movable for applying a tension in at least one direction to the ink ribbon which is situated between the thermal head and the platen, said looseness removing means being driven so as to be moved to apply said tension responsive to the thermal head supporting means being moved for pressing the thermal head against the platen, said looseness removing means applying said tension in at least one of an ink ribbon feeding direction and a direction opposite thereto when said looseness removing 2. The thermal transfer printer according to claim 1, wherein:

said ink ribbon supply mans includes a rotatable ink ribbon supply roll (41) having the ink ribbon wound thereon, and an ink ribbon take-up roll (42) for taking up the ink ribbon transported between the platen and the thermal head; and said ink ribbon looseness removing means includes a ribbon rewinding mechanism (66) for rotating the ink ribbon supply roll, thereby causing the ink ribbon to be rewound from the take-up roll onto the ink ribbon supply roll.

3. The thermal transfer printer according to claim 2, wherein said ribbon rewinding mechanism (66) includes an operating member (51) attached to the thermal head supporting means and movable together therewith, and a drive member (49, 50) attached to the platen supporting means and adapted to be actuated by the operating member for rotating the ribbon supply roll in one direction, when the thermal head supporting means is moving to cause the thermal head thereon to be pressed against the platen, and to prevent the ribbon supply roll from rotating in the other direction when the thermal head supporting means is moved in a direction such that the thermal head leaves the platen.

4. A thermal transfer printer comprising:

a platen (1);

a fixed frame (2) for supporting the platen;

a thermal head (15);

a movable frame (11) having an axis and supporting the thermal head, said movable frame being connected to the fixed frame so as to be rotatable around said axis, between a position where the thermal head is pressed against the platen and a position where the thermal head is moved away from the platen;

an ink ribbon (R);

drive means (41, 42, 46, 47) for alternately transporting the ink ribbon in one direction such that the ink ribbon is directed toward the region between the thermal head and the platen or in the direction opposite thereto; and operating means (51) for driving the drive means to move the ink ribbon in said opposite direction, for thereby applying a tension of the opposite direction to the ink ribbon, responsive to the movable frame being rotated for pressing the thermal head against the platen.

5. The thermal transfer printer according to claim 4, wherein:

said drive means includes an ink ribbon supply roll (41) having the ink ribbon wound thereon, and being rotably mounted on the fixed frame, an ink ribbon take-up roll (42) and rotably mounted on the fixed frame and being adapted to take up the ink ribbon transported between the platen and the thermal head, a first drive mechanism (46, 47) for rotating the ink ribbon take-up roll in one direction to cause the take-up roll to take up the ink ribbon, and a second drive mechanism (49, 50) for rotating the ink ribbon supply roll so that the ink ribbon moves in said opposite direction; and said operating means includes an operating member (51) attached to the movable frame for driving the second drive mechanism by utilizing the force of the rotating motion of the movable frame, thereby rocking the ink ribbon supply roll.

6. The thermal transfer printer according to claim 5, further comprising means (48) for preventing the ink ribbon take-up roll from rotating while the ink ribbon supply roll (41) is rotating in a rewinding direction.

7. The thermal transfer printer according to claim 6, wherein said second drive mechanism includes a rotating member (49, 50) rotatably mounted on the fixed frame and arranged to be rotated by the operating member, for thereby rotating the ink ribbon supply roll in the rewinding direction, when the movable frame is rotated in one 8. The thermal transfer printer according to claim 7, wherein:

said operating member includes a first gear (51); and said rotating member includes a second gear (50) mounted on the fixed frame so as to be rotatable together with the ink ribbon supply roll and for meshing with the first gear.

9. The thermal transfer printer according to claim 8, wherein said first gear and said movable frame have an axis in common, and are rotatable around said common axis, and said first and second gears are always in mesh with each other.

10. The thermal transfer printer according to claim 8, wherein said second drive mechanism includes a one-way clutch means (49*a*) for disconnecting the second gear from the ink ribbon supply roll while the movable frame is rotating in the other direction.

11. The thermal transfer printer according to claim 4, wherein said thermal head includes an elongate line thermal head.

12. The thermal transfer printer according to claim 5, wherein said second drive mechanism includes a rotating member (49, 50) rotatably mounted on the fixed frame and arranged to be rotated by the operating member, for thereby rotating the ink ribbon supply roll in the rewinding direction, when the movable frame is rotated in one direction.

13. The thermal transfer printer according to claim 12, wherein:

said operating member includes a first gear (51); and said rotating member includes a second gear (50) mounted on the fixed frame so as to be rotatable together with the ink ribbon supply roll and for meshing with the first gear.

14. The thermal transfer printer according to claim 13, wherein said first gear and said movable frame have an axis in common, and are rotatable around said common axis, and said first and second gears are always in mesh with each other.

15. The thermal transfer printer according to claim 13, wherein said second drive mechanism includes a one-way clutch means (49*a*) for disconnecting the second gear from the ink ribbon supply roll while the movable frame is rotating in the other direction.

16. The thermal transfer printer according to claim 5, wherein:

said operating member includes a first gear (51); and said rotating member includes a second gear (50) mounted on the fixed frame so as to be rotatable together with the ink ribbon supply roll and for meshing with the first gear.

17. The thermal transfer printer according to claim 16, wherein said first gear and said movable frame have an axis in common, and are rotatable around said common axis, and said first and second gears are always in mesh with each other.

18. The thermal transfer printer according to claim 16, wherein said second drive mechanism includes a one-way clutch means (49*a*) for disconnecting the second gear from the ink ribbon supply roll while the movable frame is rotating in the other direction.

19. The thermal transfer printer according to claim 18, wherein said thermal head includes an elongate line thermal head.

20. The thermal transfer printer according to claim 17, wherein said thermal head includes an elongate line thermal head.

* * * * *